United States Patent [19]

Klem

[11] 4,241,852

[45] Dec. 30, 1980

[54] DISPENSING CONTAINER FOR BUTTER HAVING FOLLOWER

[76] Inventor: Stanley J. Klem, 2607 Wyndham La., Orlando, Fla. 32808

[21] Appl. No.: 882,348

[22] Filed: Mar. 1, 1978

[51] Int. Cl.[2] ..... B65D 35/28

[52] U.S. Cl. ..... 222/103; 222/387; 222/494

[58] Field of Search ..... 137/855, 856; 401/282, 401/283, 286-288; 222/103, 107, 386, 387, 494

[56] References Cited

U.S. PATENT DOCUMENTS

| | | | |
|---|---|---|---|
| 1,881,488 | 10/1932 | Gleason | 222/494 |
| 1,934,045 | 11/1933 | Devlin et al. | 222/494 |
| 1,991,126 | 2/1935 | Stevenson | 222/494 X |
| 2,568,286 | 9/1951 | Littlefield | 222/103 |
| 2,597,273 | 5/1952 | Scott | 222/103 |

FOREIGN PATENT DOCUMENTS

| | | | |
|---|---|---|---|
| 556804 | 7/1923 | France | 222/103 |
| 1166227 | 11/1958 | France | 222/103 |
| 327217 | 3/1958 | Switzerland | 222/103 |

*Primary Examiner*—David A. Scherbel
*Attorney, Agent, or Firm*—Stanley J. Klem

[57] ABSTRACT

A dispensing container for storing and dispensing prepackaged quarter pound segments of softened butter or similar dispensible materials. Segments of butter prepackaged in plastic envelopes are constrained between a movable butter feed plate and a stationary base in conjunction with a sealing plate within the container for dispensing butter therefrom. The sealing plate includes a hinged sealing edge that cooperates with a rigid feed lip at the front of the container to define a feed passageway and to seal an end of the envelope that is disposed therebetween. Depressing the feed plate compresses the pre-softened butter within the packaging envelope to open the feed passageway and force butter through the envelope end. When the feed plate is released, the feed passageway is automatically sealed.

5 Claims, 8 Drawing Figures

DISPENSING CONTAINER FOR BUTTER HAVING FOLLOWER

BACKGROUND OF THE INVENTION

This invention relates to dispensing containers and more particularly to containers for storing and selectably dispensing softened butter or similar dispensible material from pre-packaged envelopes.

It is to be understood that the term "dispensible materials" is to include all materials that may be dispensed in the instant invention.

Butter and oleomargarine are commonly distributed for home use in one-pound quantities cut into one-quarter pound segments. For purposes of clarity, only butter will hereafter be referred to in the following specification. Since quarter-pound quantities are most commonly used in households, the instant application will relate to these quarter-pound segments.

Many people prefer that butter be at room temperature consistency before spreading it on bread or use it for cooking purposes. The most common means to store butter is in elongated butter dishes with removable covers. The butter is allowed to soften at room temperature and is easily spread thereafter.

Although the softening of butter before use renders it more suitable for spreading on bread without damaging the bread, certain undesirable effects occur.

For example, when bread is toasted and soft butter is spread with a spatula, crumbs from the toast being buttered, adhere to the spatula. During repeated use, these crumbs are transferred to the soft butter supply. This condition occurs regardless of the care exercised by the user. The result is a soft butter supply that is polluted with residue toast crumbs making it unsightly and unappetizing. In many cases the remaining butter supply is discarded or the polluted area removed. In any case, wasted butter is the end result.

Furthermore, when the butter supply in the butter dish is exhausted, the butter residue remaining in the dish is messy and the dish must be cleaned before reusing.

Moreover, if a butter supply is allowed to stand in the butter dish for an extended period of time, it becomes contaminated with environmental odors resulting in an unpleasant tasting butter which is usually discarded as waste.

The instant invention overcomes these undesirable features by eliminating the exposed butter supply by providing a re-fillable dispensing container that dispenses butter from butter segments pre-packaged in plastic envelopes.

SUMMARY OF THE INVENTION

A compact container is provided for storing and selectably dispensing softened butter. The dispensing container accomodates one-quarter pound segments that are packaged in plastic envelopes.

The dispensing container includes a butter compartment that cooperates with a movable feed plate and a stationary base in combination with a sealing plate to compress an envelope of softened butter there between and feed butter from the butter compartment.

A sealing plate slides and is retained in grooves disposed in opposing side walls of the butter compartment. The sealing plate, when fully inserted, cooperates with a rigid plate at the front of the compartment to define a butter passageway. A sealing edge at the front of the sealing plate presses against the rigid plate to pinch any material there between.

The dispensing container is easily prepared for use by removing the sealing plate and inserting a pre-packaged segment of butter from the top of the butter chamber. The end of the packaging envelope is manually guided under the feed lip. The sealing plate is re-inserted and the edge thereof presses against the rigid feed lip to confine and seal the end of the packaging envelope therebetween. The feed plate is then inserted above the packaged butter supply.

The envelope portion extending beyond the feed lip is severed and the butter supply is allowed to soften at room temperature.

Butter is easily dispensed by depressing the feed plate which compresses the envelope of softened butter to force butter between the rigid feed lip and the sealing edge to open the butter passageway and allow butter to flow there through. Releasing the pressure on the feed plate allows the sealing edge to pinch the butter envelope and close the butter passageway.

When the butter supply is exhausted, the empty envelope is discarded and a new packaged butter segment inserted.

Accordingly, it is an object of the present invention to provide a dispensing container for selective dispensing of softened butter or similar material from a plastic envelope.

It is still another object of the present invention to provide a dispensing container for softened butter that minimizes waste.

It is a further object of the present invention to provide a dispensing container for softened butter that eliminates the necessity of cleaning before refilling.

It is still a further object of the present invention to provide a dispensing container for softened butter that is of simple construction.

It is still a further object of the present invention to provide a dispensing container for storing butter or similar material and to protect the contents thereof from environmental odors.

Other objects, features and advantages of the invention will become more apparent from the following description, including appended claims and accompanying drawings.

DESCRIPTION OF THE PREFERRED EMBODIMENT

Figures 1, 2, 3, 4:
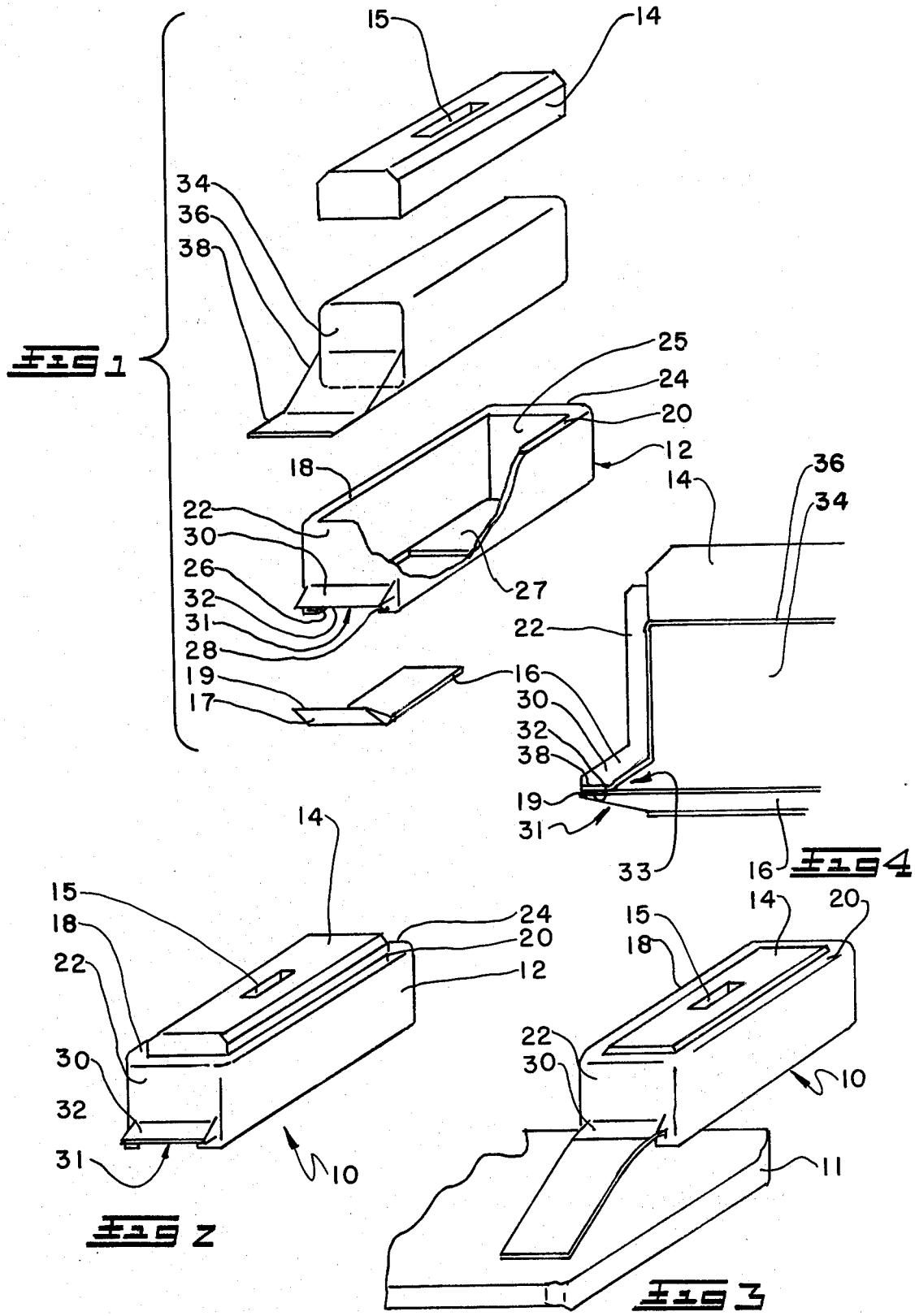
FIG. 1 is an exploded perspctive view of the invention showing a pre-packaged segment of butter, the invention components and their assembled relationship to one another.
FIG. 2 is a perspective view showing the present invention fully assembled and operational.
FIG. 3 is a perspective view of the present invention during a dispensing operation.
FIG. 4 is a section view of a portion of FIG. 2.

Referring now to the drawings and in particular to FIGS. 1 and 2, there is shown an elongated dispensing container 10 comprised of a butter compartment 12, a feed bar 14 and a sealing plate 16.

Butter compartment 12 is of molded construction and is defined by a pair of parallel side walls 18, 20 spaced apart by a pair of parallel end walls 22, 24 that define a butter chamber 25.

Side walls 18, 20 include opposing guide grooves 26, 28 that are spaced from and extend less than the length of the lower edge of the walls.

A partial base 27 spans the bottom of chamber 25 and terminates at the end of grooves 26, 28.

Projecting outward from end wall 22 is a rigid feed lip 30 that spans the width of butter chamber 25. Feed lip 30 includes an undersurface 32 normal to the surface of end wall 22.

An aperture 31 in wall 22 underlying feed lip 30 has been provided to allow unrestricted entry of sealing plate 16.

Feed bar 14 spans the length and width of and is slideable within butter chamber 25. The length and width of bar 14 are sufficient to provide positive guiding by the inner surfaces of butter chamber 25. It is recommended that feed bar 14 include a centrally disposed opening 15 to allow any entrapped air to be vented during operation.

Sealing plate 16 is of plate-like construction and spans the bottom of butter chamber 25 when fully inserted in grooves 26 and 28. Sealing plate 16 includes an angled end portion 17. End portion 17 is molded with its thickness tapered down to a thin sealing edge 19 and cooperates with feed lip 30 to define a butter passageway 33. Thickness of angled portion 17 at its base is relieved to impart flexibility to it. Sealing plate 16 freely slides in guide grooves 26, 28 of butter compartment walls 18, 20. Just prior to full insertion, sealing edge 19 contacts undersurfaces 32 of feed lip 30 and is deflected downward as clearly shown in FIG. 4. As sealing plate 16 is fully inserted, sealing edge 19 is biased against undersurface 32 of feed lip 30.

Preparatory to a dispensing operation of the dispensing container, a butter supply is inserted by first removing feed bar 14 and sealing plate 16. A quarter-pound segment of butter 34 that is pre-packaged in a plastic envelope 36, is oriented with an envelope extension 38 projecting through aperture 31. The butter supply is then fully inserted in butter chamber 25.

Sealing plate 16 is aligned with guide grooves 26, 28 and slid in place. Envelope extension 38 is held fast to insure that it extends beyond feed lip 30 as sealing plate 16 is being inserted where it is pinched between sealing edge 19 and feed lip undersurface 32 to close butter passageway 33. The excess envelope extension including the envelope seal projecting beyond feed lip 30 is removed. Feed bar 14 is aligned with the top of butter chamber 25 and placed in position on top of butter 34. At this time the butter supply is confined between feed bar 14 and base 27 along with sealing plate 16. The butter supply is allowed to soften at room temperature and the dispensing container is operational as shown in FIG. 2.

In operation, dispensing container 10 is held with feed lip 30 positioned above a dispensing area depicted in FIG. 3 as a slice of bread 11.

Feed bar 14 is depressed to compress the softened butter within envelope 36 to force open butter passageway 33 and dispense a thin ribbon of butter as shown in FIG. 3. Releasing the pressure on feed bar 14 allows the sealing edge to pinch the butter envelope and close butter passageway 33.

When the butter supply is exhausted, feed bar 14 and sealing plate 16 are removed, the empty envelope is discarded and a new butter supply inserted.

FIGS. 5–8 illustrate a second embodiment of the invention.

Figure 5:
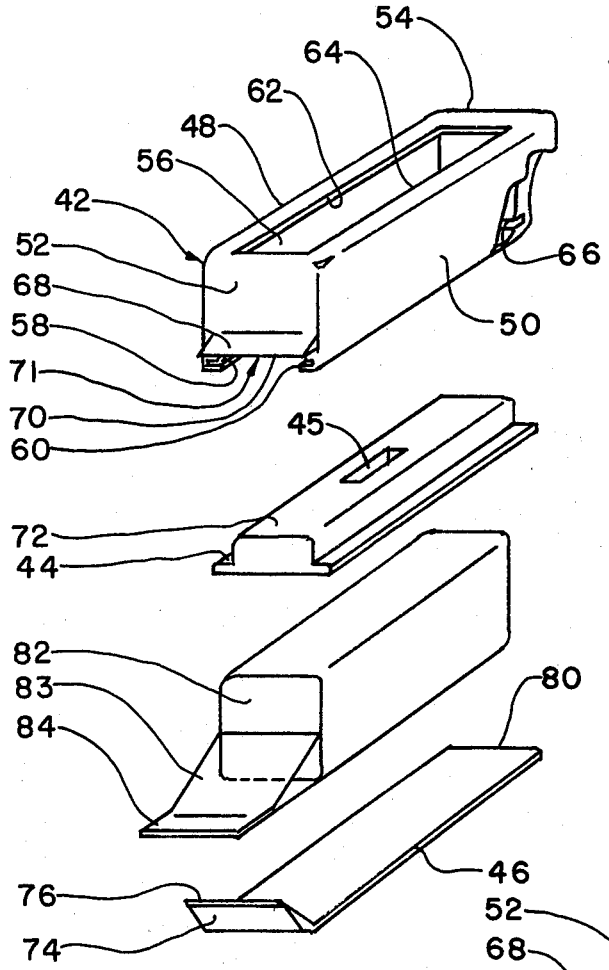
FIG. 5 is an exploded perspective view of a second embodiment of the invention showing a pre-packaged segment of butter, the invention components and their assembled relationship to one another.

FIG. 5 in particular shows an elongated dispensing container 40 comprised of a butter compartment 42, a feed plate 44 and a sealing plate 46.

Butter compartment 12 is of molded construction and is defined by a pair of parallel side walls 48, 50 spaced apart by a pair of parallel end walls 52, 54 that define a butter chamber 56.

Side walls 48, 50 include opposing guide grooves 58, 60 respectively that are spaced from and extend the length of the lower edge of the walls.

Projecting inward from the top edge of side walls 48, 50 are opposing retaining flanges 62, 64 that extend the length of butter chamber 56. A guide groove 66 is disposed in end wall 54 and is in alignment with guide grooves 58, 60 of side walls 48, 50.

Projecting outward from end wall 52 is a rigid feed lip 68 that extends the width of butter chamber 56. Feed lip 68 includes an undersurface 70 normal to the surface of end wall 52.

An aperture 71 in wall 52 underlying feed lip 68 has been provided to allow unrestricted entry of sealing plate 46.

Feed plate 44 spans the length and width and is slideable within butter chamber 56. The length and width of feed plate 44 are sufficient to provide positive guiding by the inner surfaces of the butter chamber.

It is recommended that feed plate 44 include a centrally disposed opening 45 to allow any entrapped air to be vented during operation.

Feed plate 44 is of plate-like construction and includes a centrally disposed elevated depress bar 72. The ends of bar 72 are in planar alignment with the ends of feed plate 44 to provide additional guiding of the feed plate as it slides within butter chamber 56.

Sealing plate 46 is of plate-like construction and spans the bottom of butter chamber 56 when fully inserted in grooves 58 and 60.

Sealing plate 46 includes an angled end portion 74. End portion 74 is molded with its thickness tapered down to a thin sealing edge 76 and cooperates with feed lip 68 to define a butter passageway 78. The thickness of angled portion 17 at its base is relieved to impart flexibility. Sealing plate 46 freely slides in guide grooves 58, 60 of walls 48 and 50. Just prior to full insertion, sealing edge 76 contacts undersurface 70 of feed lip 68 and is deflected downward as clearly shown in FIG. 8. As sealing plate 46 is fully inserted, a rear edge 80 is seated in groove 66 in end wall 54 and sealing edge 76 is biased against undersurface 70 of feed lip 68.

Preparatory to a dispensing operation a butter supply is inserted in dispensing container 10 by first inverting the container and disassembling the container. Feed plate 44 is oriented with depress bar 72 toward the bottom, aligned with butter chamber 56 and inserted therein.

A quarter-pound segment of butter 82 pre-packaged in a plastic envelope 83 is oriented with an envelope extension 84 towards the front of dispensing container 10 overlying undersurface 70 of feed lip 68 and inserted. Feed plate 44 is constrained within butter chamber 56 by flanges 62 and 64.

Sealing plate is aligned with guide grooves 58, 60 and slid in place between side walls 48 and 50 to confine butter 82 and envelope 83 between feed plate 61 and sealing plate 46 in butter chamber 56. Envelope extension 84 is held fast to insure that it extends beyond feed lip 68 as sealing plate 46 is being inserted where it is pinched between sealing edge 76 and feed lip undersurface 70 to close butter passageway 78. The excess envelope extension including the envelope seal projecting beyond feed lip 68 is removed.

Figure 6:
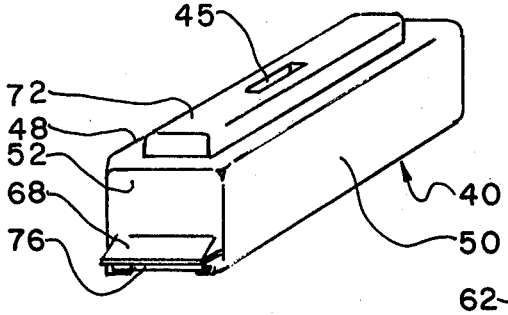
FIG. 6 is a perspective view of the invention showing the present invention fully assembled and operational.
Figure 8:
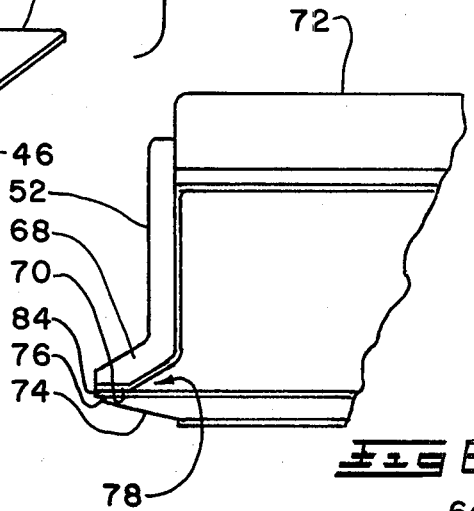
FIG. 8 is an enlarged section view of a portion of FIG. 6.

The butter supply within the container is allowed to soften at room temperature and the dispensing container is operational as shown in FIG. 6.

Figure 7:
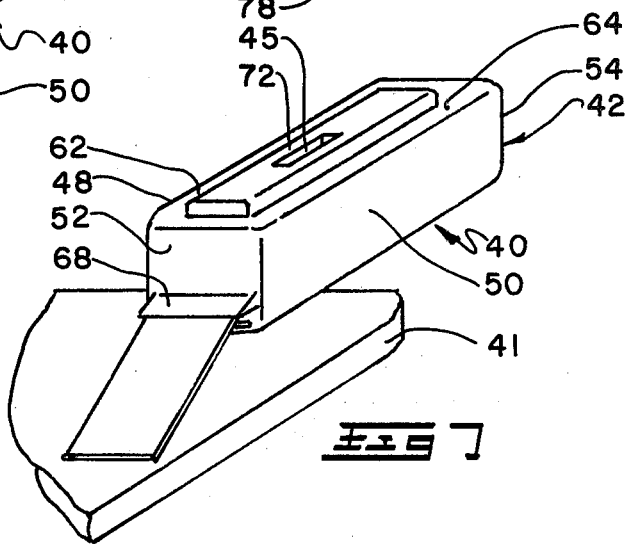
FIG. 7 is a perspective view of the present invention during a dispensing operation.

In operation, dispensing container 40 is maneuvered with feed lip 68 positioned above a dispensing area depicted in FIG. 7 as a slice of bread 41.

Depress bar 72 is pressed, and feed plate compresses the softened butter within envelope 83 to force open butter passageway 78 and dispense a thin ribbon of butter as shown in FIG. 7. Releasing the pressure on depress bar 72 allows the sealing edge to pinch the butter envelope and close butter passageway 78.

When the butter supply is exhausted, sealing plate 46 is removed, the empty envelope is discarded and a new supply inserted.

While the foregoing description has shown and described the fundamental novel features as applied to a preferred embodiment, it will be understood by those skilled in the art that modifications embodied in various forms may be made without departing from the spirit and scope of the invention.

I claim:

1. A dispensing container for dispensing softened butter or similar material from pre-packaged envelopes, the dispensing container comprising:

a frame including an upper aperture and a lower aperture in alignment with one another and further includes a first and second elongated side wall spaced from one another by a front and rear end wall for defining the contour of the container;

a top member of plate-like construction and includes a centrally disposed elevated portion projecting from said top member for guiding the motion of said member and wherein said top member is partially insertable into and spans said upper frame aperture from below and is movable relative to said frame;

a base member that spans said lower aperture and is engageable by and movable relative to said frame;

a sealable passageway disposed at one end of said frame to permit prepackaged softened material disposed between said top member and said base member to flow through said passageway; and a lip projecting from the lowermost edge of said front end wall for defining the upper limit of said passageway.

2. A dispensing container for dispensing softened butter or similar material from pre-packaged envelopes, the dispensing container comprising:

a frame including an upper aperture and a lower aperture in alignment with one another and further includes a first and second elongated side wall spaced from one another by a front and rear end wall for defining the contour of the container;

a top member of plate-like construction and includes a centrally disposed elevated portion projecting from said top member for guiding the motion of said member and wherein said top member is partially insertable into and spans said upper frame aperture from below and is movable relative to said frame;

a base member that spans said lower aperture and is engageable by and movable relative to said frame;

a sealable passageway disposed at one end of said frame to permit pre-packaged softened material disposed between said top member and said base member to flow through said passageway;

a lip projecting from the lowermost edge of said front end wall for defining the upper limit of said passageway; and a flexible extension integral with said base member projecting beyond said front end wall proximate said projecting lip for defining the lower limit of said passageway.

3. A dispensing container for dispensing softened butter or similar material from pre-packaged envelopes, the dispensing container comprising:

a frame including an upper aperture and a lower aperture in alignment with one another and further includes a first and second elongated side wall spaced from one another by a front and rear end wall for defining the contour of the container;

a top member of plate-like construction and includes a centrally disposed elevated portion projecting from said top member for guiding the motion of said member and wherein said top member is partially insertable into and spans said upper frame aperture from below and is movable relative to said frame;

a base member that spans said lower aperture and is engageable by and movable relative to said frame;

a sealable passageway disposed at one end of said frame to permit pre-packaged softened material disposed between said top member and said base member to flow through said passageway;

a lip projecting from the lowermost edge of said front end wall for defining the upper limit of said passageway;

a flexible extension integral with said base member projecting beyond said front end wall proximate said projecting lip for defining the lower limit of said passageway; and a sealing edge on said flexible extension, said sealing edge biased against said projecting lip for sealing the envelope disposed therebetween.

4. A dispensing container for dispensing softened butter or similar material from pre-packaged envelopes, the dispensing container comprising:

a frame including an upper aperture and a lower aperture in alignment with one another and further includes a first and second elongated side wall spaced from one another by a front and rear wall for defining the contour of the container;

a top member of plate-like construction and includes a centrally disposed elevated portion projecting from said top member for guiding the motion of said member and wherein said top member is partially insertable into and spans said upper frame aperture from below and is movable relative to said frame;

a base member that spans said lower aperture and is engageable by and movable relative to said frame;

a sealable passageway disposed at one end of said frame to permit pre-packaged softened material disposed between said top member and said base member to flow through said passageway;

a lip projecting from the lowermost edge of said front end wall for defining the upper limit of said passageway;

a flexible extension integral with said base member projecting beyond said front end wall proximate said projecting lip for defining the lower limit of said passageway; and a sealing edge on said flexible extension, said sealing edge biased againt said projecting lip for sealing the envelope disposed therebetween.

an aperture disposed in said top member for venting entrapped air within said chamber.

5. A dispensing container for dispensing softened butter or similar material from pre-packaged envelopes, the dispensing container comprising:

a frame including a base, a first and a second enlongated side wall integral therewith spaced apart by a front and a rear end wall to define chamber having an aperture;

a feed member movable relative to said base spans said frame aperture and includes an orifice for venting entrapped air within said chamber; and a sealable passageway disposed at one end of said frame, the upper limit of said passageway being defined by a lip projection from said front wall and the lower limit of said passageway being defined by a flexible base extension that projects beyond said front wall, said flexible extension including a sealing edge biased against said projecting lip for pinching an end portion of the pre-packaged envelope disposed therebetween.

* * * * *